United States Patent [19]

Ueno et al.

[11] Patent Number: 4,769,303

[45] Date of Patent: Sep. 6, 1988

[54] ELECTROPHOTOGRAPHIC PHOTOSENSITIVE MEMBER

[75] Inventors: Tsuyoshi Ueno, Fujisawa; Akira Sanjoh, Kawasaki, both of Japan

[73] Assignee: Kabushiki Kaisha Toshiba, Kawasaki, Japan

[21] Appl. No.: 17,874

[22] Filed: Feb. 24, 1987

Related U.S. Application Data

[63] Continuation of Ser. No. 779,850, Sep. 25, 1985, abandoned.

[30] Foreign Application Priority Data

Sep. 27, 1984 [JP] Japan ..... 59-200653

[51] Int. Cl.[4] ..... G03G 5/08; G03G 5/14

[52] U.S. Cl. ..... 430/64; 430/67; 430/84; 430/95

[58] Field of Search ..... 430/58, 66, 84, 95, 430/64

[56] References Cited

U.S. PATENT DOCUMENTS

| | | | |
|---|---|---|---|
| 4,225,222 | 9/1980 | Kempter | 430/95 |
| 4,265,991 | 5/1981 | Hirai et al. | 430/61 |
| 4,359,512 | 11/1982 | Fukuda et al. . | |
| 4,359,514 | 11/1982 | Shimizu et al. | 430/65 |
| 4,523,214 | 6/1985 | Hirose et al. | 427/87 |
| 4,560,634 | 12/1985 | Matsuo et al. | 430/95 |
| 4,582,773 | 4/1986 | Johncock et al. | 430/64 |

FOREIGN PATENT DOCUMENTS

| | | |
|---|---|---|
| 0066812 | 5/1982 | European Pat. Off. . |
| 3134189 | 4/1982 | Fed. Rep. of Germany . |
| 3305091 | 8/1983 | Fed. Rep. of Germany . |
| 2087643 | 9/1982 | United Kingdom . |

OTHER PUBLICATIONS

Abstract—59-121049(A), Electrostatic Printing Device.

Abstract—59-121050(A), Electrophotographic Sensitive Body.

Abstract—59-121051(A), Electrophotographic Sensitive Body.

*Primary Examiner*—John L. Goodrow

*Attorney, Agent, or Firm*—Cushman, Darby & Cushman

[57] ABSTRACT

An electrophotographic photosensitive member comprises a conductive substrate, a blocking layer formed on the conductive substrate, a photoconductive layer, formed on the blocking layer and a surface layer formed on the photoconductive layer. The blocking layer is formed from a microcrystalline silicon, which is made a p-type by being heavily doped with an element of Group III of the Periodic Table. The photoconductive layer is formed from an amorphous silicon which is lightly doped with an impurity element, and which is similar in properties to an intrinsic semiconductor. Rectifying contact is formed between the photoconductive layer and the blocking layer so that a depletion layer is formed by that interface toward the interior of the photoconductive layer. By so doing, it is possible to obtain a photosensitive member having a high sensitivity in the range from visible light to near-infrared light.

12 Claims, 2 Drawing Sheets

ELECTROPHOTOGRAPHIC PHOTOSENSITIVE MEMBER

This is a continuation of application Ser. No. 779,850, filed Sept. 25, 1985, which was abandoned upon the filing hereof.

BACKGROUND OF THE INVENTION

This invention relates to an electrophotographic photosensitive member which possesses photoconductivity upon illumination with electromagnetic light in the infrared, visible, ultraviolet, X-ray, and γ-ray region, and which permits an image to be formed after the formation of an electrostatic latent image.

In image forming technique, such as an electrophotography, or image pickup, use is made of a photoconductive material which shows photoconductivity upon illumination by light. Recently, attention has been paid to an amorphous silicon (hereinafter referred to as an a—Si) as a photoconductive material. In comparison with a photoconductive material selected from an inorganic material, such as Se, CdS, Se—Te alloy or Se—As alloy, or an organic material, such as a PVCz or TNF, the a—Si film has the advantages of having an excellent spectral sensitivity over the visible light range, a high surface hardness, and of being easy to handle, durable at a high temperature, and pollution-free. Furthermore, the a—Si film, if a high-frequency glow discharge decomposition method is used, can be formed with a larger area and a uniform thickness, without any film formation restrictions resulting from the shape and material of the substrate.

If the a—Si is used for the electrophotographic photosensitive member, since the resistivity, in the dark, of the a—Si (hereinafter referred to as dark resistivity) is usually of the order of $10^8$ to $10^{10}$ Ω·cm, it is not possible in that instance to retain charges on the surface of the electrophotographic photosensitive member made from the a—Si. Therefore, attempts have been made to enhance the dark resistivity through the doping of a small quantity of an impurity element of Group III of the Periodic Table, such a B, Al, Ga and In, into a photoconductive layer (where photocarriers are generated) to thus enhance the charge retention capability of the photosensitive member. When using this technique, however, the charge retention capability of the photosensitive member is not sufficient, since it is difficult for the photoconductive layer alone to retain the charges at the charging time. It is, therefore, not possible to suppress the dark decay.

It may be possible, however, to sandwich the photoconductive layer with high-resistance insulating layers. When the photoconductive layer is electrified to form charges at the surface, they are retained by the high-resistance insulating layer at the surface of the photoconductive layer, and the transfer of the charges from the conductive substrate into the photoconductive layer is suppressed by the high-resistance insulating layer which is formed between the photoconductive layer and the conductive substrate. In this technique, however, a breakdown occurs due to the concentration of an electric field toward the high-resistance insulating layer, causing carriers to be stored at the interface between the high-resistance insulating layer and the photoconductive layer, with the result that residual potential is enhanced.

SUMMARY OF THE INVENTION

It is accordingly the object of this invention to provide an electrophotographic photosensitive member which is high in charging, and charge retention capability, low in residual potential and high in sensitivity.

According to this invention, there is provided an electrophotographic photosensitive member which comprises a conductive substrate, a blocking layer of a microcrystalline silicon formed on the conductive substrate, and a photoconductive layer of an amorphous silicon formed on the blocking layer, such that it is in rectifying contact with the microcrystalline silicon of the blocking layer, to form a depletion layer in the neighborhood of the contact area.

According to this invention, the blocking layer of microcrystalline silicon is formed between the photoconductive layer of an amorphous silicon and the conductive substrate, and rectifying contact is made between the amorphous silicon and the microcrystalline silicon. The depletion layer is formed by the interface between the two toward the photoconductive layer. Such an electrophotographic photosensitive member has both high charging and charge retention capability, and is low in residual potential. Furthermore, the photosensitive member has a high sensitivity over a wider wavelength region, from visible light to longer wavelength light, such as near-infrared light. Thus, the photosensitive member can be used for a laser printer using the long wavelength light of 790 nm, and for a PPC (plain paper copier) using visible light.

DETAILED DESCRIPTION OF THE PREFERRED EMBODIMENTS

Figure 1:
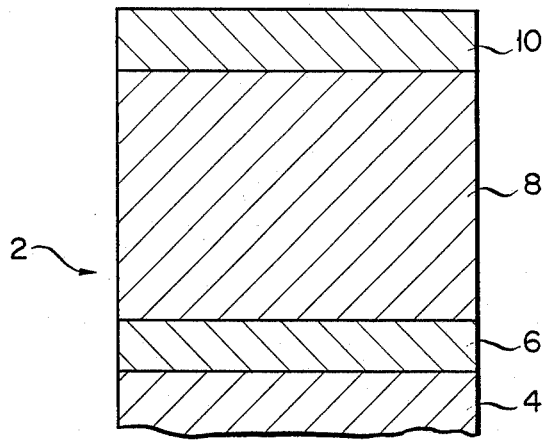
FIG. 1 is a cross-sectional view showing part of an electrophotographic photosensitive member according to one embodiment of this invention.

In an electrophotographic photosensitive member 2 shown in FIG. 1, a blocking layer 6 of a microcrystalline silicon (hereinafter referred to as μc—Si) is formed on a conductive substrate 4. A photoconductive layer 8 of an amorphous silicon is formed on the blocking layer 6, and a surface layer 10 is formed on the photoconductive layer 8.

The conductive substrate may be made of metal, such as aluminum or stainless steel, or may be formed by coating a conductive or semi-conductive material on the surface of a glass or polymer film. The substrate may be utilized in the form of a flat plate or a drum.

Blocking layer 6 is composed of μc—Si. This material, μc—Si, is clearly distinguished from a—Si and polycrystalline silicon with respect to their material properties as set out below. That is, since a—Si takes an amorphous form on the measurement of the X-ray diffraction pattern, a "halo" emerges, failing to allow observation of a diffraction peak. However, μc—Si shows a crystal diffraction peak with $2\theta$ in the range of 27 to 28.5 deg. The polycrystalline silicon has a dark resistivity of $10^6$ Ω·cm, while the μc—Si has a dark resistivity of more than $10^{11}$ Ω·cm. The μc—Si is composed of an aggregate of microcrystals with a grain size of about 10 Å or above.

Due to the suppression of the flow of carriers between conductive substrate 4 and photoconductive layer 8, blocking layer 6 enhances carrier retaining function on the surface of the photosensitive member, serving to enhance the electrical charging capability of the photosensitive member. Since blocking layer 6 is composed of μc—Si, it shows a low resistivity and greater mobility, permitting fast movement of the carriers into substrate 4. In consequence, since no carriers remain in blocking layer 6, and a residual potential (i.e. the surface potential of the photosensitive member, after light illumination) is low, the diffusion length of the carriers extends towards the conductive substrate with the carriers so migrated, thus facilitating arrival of the carriers at the conductive substrate. As a result, it is possible to enhance the charging capability with which the surface of the photosensitive member is electrically charged to enhancing the high potential level, as well as a charge retention capability by which the charges are retained for a longer time.

Although μc—Si per se is somewhat of n-type, it is doped with a particular impurity based on a choice of use of the photosensitive member, to make blocking layer 6 p-type or n-type. That is, where the surface of the photosensitive member is positively charged, the blocking layer is made p-type, so as to prevent electrons from being transferred from the substrate into the photoconductive layer. Where, on the other hand, the surface of the photosensitive material is negatively charged, the blocking layer is made on n-type, so as to transfer holes from the substrate into the photosensitive layer. In order to make μc—Si p-type, it may be doped with an element of Group III of the Periodic Table, such as B, Al, Ga, In or TI. In order to make μc—Si n-type, it may be doped with an element of Group V of the Periodic Table, such as N, P or As. The thickness of the blocking layer is preferably 0.1 to 3 μm and more preferably 0.5 to 2 μm.

The μc—Si has a small optical band gap, as compared with a—Si. For this reason, μc—Si has an absorptive power, for a light beam, of 790 nm which is the oscillation wavelength of a laser beam. The laser beam has high transmission and penetrates deeply into the photosensitive member. Most of the laser beam is reflected on substrate 4, made of, for example, Al. In the case of the laser beam, therefore, an irregular fringe-like picture is liable to occur due to the interference of the light beam reflected on the substrate, with the light beam reflected on the surface of the photosensitive member. If μc—Si is used as the blocking layer, light is then absorbed by the blocking layer, due to the higher sensitivity of μc—Si per se longer wavelength light, before it reaches the Al substrate, reducing thereby the reflected light and thus suppressing the generation of the irregular fringe-like picture.

Photoconductive layer 8 of a—Si is in rectifying contact with blocking layer 6 of μc—Si. That is, for a blocking layer 6 of p-type, the photoconductive layer 8 is made somewhat n-type, while, for a blocking layer 6 of n-type, the photoconductive layer 8 is made somewhat p-type. A pn junction is formed between photoconductive layer 8 and blocking layer 6. In this case, impurity elements to be doped into a—Si photoconductive layer 8 are the same as in the case of μc—Si blocking layer 6. However, in this case, the amount of doping impurity is light, on the order of $10^{-7}$ to $10^{-3}$ atomic % (light doping). For this reason, photoconductive layer 8 of a—Si is of n-type or p-type, permitting the obtainment of a nearly intrinsic type semiconductor.

A depletion layer of fewer carriers is formed in the neighborhood of an interface between photoconductive layer 8 and blocking layer 6. Due to higher resistance of the depletion layer, the photosensitive member has a still higher charging, and charge retention capability. The depletion region is widened more toward photoconductive layer 8 of less impurity and thus is formed deep in photoconductive layer 8. The depletion layer has a sensitivity to visible light to near-infrared light and, through the absorption of light, generates carriers. Of the light incident to the surface of the photosensitive member, the long-wavelength light penetrates relatively deeply into photoconductive layer 8, and is absorbed in the depletion layer. As a result, it is possible to obtain a photosensitive member with a high sensitivity to long wavelength light.

Figure 2:
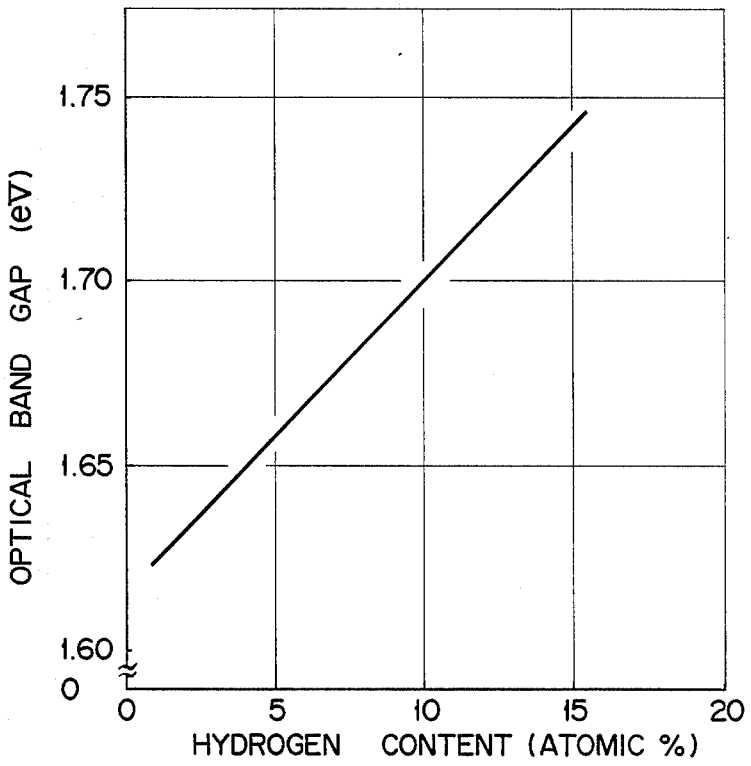
FIG. 2 is a graphic representation showing the relation between the content of hydrogen in a—Si and an optical band gap.

An a—Si layer is usually formed by use of $SiH_4$ gas only, and has excellent electrical properties of about $10^{11}$ Ω·cm dark resistivity, and about $10^6$ Ω·cm resistivity under light illumination of $1\times10^{16}$ photons/cm$^2$·sec., against 633 nm wavelength light and an S/N ratio of above $10^4$. During the formation of the a—Si layer, there will usually be hydrogen contained in the a—Si layer. FIG. 2 is a graphical representation showing the relation between the hydrogen content in the a—Si layer and the optical band gap of the a—Si layer. As can be appreciated from this graph, the higher the hydrogen content, the greater the optical band gap. Since the long wavelength light has less energy, the optical band gap becomes greater, failing to excite carriers beyond the gap. Thus, the greater the optical band gap, the lower the sensitivity to long wavelength light. In order to secure an adequate sensitivity to laser light of 790 nm wavelength, as used, for example, in a laser printer, the hydrogen content should be below 10 atomic %. By so doing, the optical band gap is 1.65 to 1.70 eV, showing a high sensitivity to long wavelength light. In order to enhance the dark resistivity and electrical charging capability, it is possible to lightly dope an element of Group III of the Periodic Table into the a—Si layer. The photoconductive layer has a thickness of preferably 5 to 50 μm and more preferably 10 to 40 μm.

Ge may be doped, so as to enhance the sensitivity of the photoconductive layer to long wavelength light. Because $GeH_4$ gas is costly, and because $GeH_2$ and $SiH_4$ gases are decomposed at a different temperature, the $GeH_4$ gas is trapped in the layer of the photosensitive member due to inadequate decomposition of the gas, causing the electrophotographic characteristic to be degraded. It is, therefore, not desirable to enhance the sensitivity by doping with Ge.

Surface layer 10 is a high-resistivity layer for surface stability and can be formed by the use of a hydrogen-containing silicon carbide. Surface layer 10 is preferably 0.01 to 10 μm and more preferably 0.05 to 5 μm.

Figure 3:
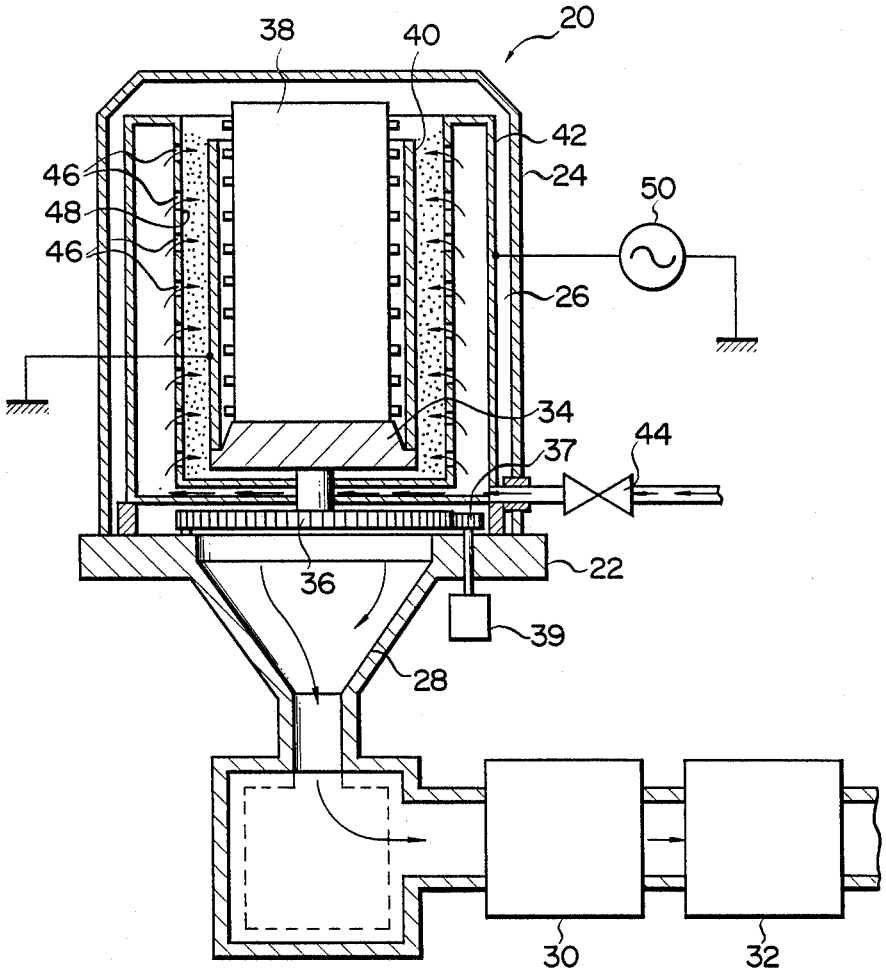
FIG. 3 is a view showing an apparatus for manufacturing an electrophotographic photosensitive member.

FIG. 3 shows an apparatus 20 for manufacturing an electrophotographic photosensitive member according to the embodiment of this invention. A housing 24 is located, in an airtight fashion, on a base 22, and has a reaction chamber 26 therein. Base 22 is connected through a pipe-like communication member 28 to a mechanical booster pump 30, and then to a rotary pump 32. Reaction chamber 26 is exhausted by pumps 30 and 32 to, for example, a pressure of $10^{-3}$ to $10^{-4}$ torr. A gear 36 is located below a drum, holding member 34.

Drum-holding member 34 is supported by base 22, through gear 36, such that it is rotatable with the rotational center of gear 36 as the center. A rotor 39 is ground against substrate 22 and a gear 37 is attached to rotational shaft of the motor 39. Gear 37 is in mesh with gear 36. A cylindrical, conductive drum substrate 40, drum-holding member 34 and heater 38 are rotationally driven, by the rotation of motor 39, through gears 36 and 37. Heater 38 is located at the center of drum-holding member 34, and drum substrate 40 is located on drum-holding member 34, with heater 38 therearound. A cylindrical, gas-introducing member 42 is placed on base 22, with drum substrate 40 therearound. The inner space of gas-introducing member 42 is connected to an external gas supply source, not shown, through a valve 44. A plurality of gas blow-off holes 46 are formed in the inner wall of the gas introducing member. Thus, gas supplied into gas-introducing member 42 through valve 44 is blown into the space between gas-introducing member 42 and drum substrate 40, through gas blow-off holes 46. The inner wall of gas-introducing member 42 acts as an electrode 48 which, in turn, is connected to a high frequency power source 50. Drum substrate 40 is grounded. p In apparatus 20, housing 24 is removed from base 22. and drum substrate 40 is located on drum-holding member 34. Then, housing 24 is placed, in an airtight fashion, on base 22, and chamber 26 is evacuated by rotary pump 32 to a vacuum level of $10^{-3}$ to $10^{-4}$ torrs. Conversely, drum substrate 40 is heated by heater 38 to 150° to 300° C. Then, the exhaust system of chamber 26 is switched from rotary pump 32 to mechanical booster pump 30 and, at the same time, valve 44 is opened and a feed gas is supplied to chamber 26. As feed gas, use may be made of a silicon-atom gas, such as $SiH_4$, $Si_2H_6$, or $SiF_4$ gas. The feed gas is blown from gas blow-off holes 48 toward drum substrate 40, and exhausted through mechanical booster pump 30. In this case, the feed gas in reaction chamber 26 is adjusted to a pressure level of 0.1 to 1 torr, by controlling outputs of the valve 44 and mechanical booster pump 30. Drum substrate 40 is rotationally driven by motor 39 and a high frequency power of, for example, 3.56 MHz is applied. By so doing, a glow discharge occurs in the feed gas between electrode 48 and drum substrate 40, and the μc—Si layer, a—Si layer and surface layer as shown in FIG. 1, are formed on the drum substrate by the continuous supply of the feed gas. Where the impurity element is to be doped, gas containing atoms to be doped have only to be supplied when the Si-containing gas is supplied. In this connection it is to be noted that the valance electrons of the a—Si layer can be controlled by the doping of an element of Group III or Group V of the Periodic Table. In this case, it shows a smaller resistivity when a heavy doping is effected with an element of Group III or Group V, and a greater resistivity when a light doping is effected with an element of Group III.

Examples of this invention will be explained below, in relation to a Comparative Example:

The Al drum, which was thoroughly washed and dried, was placed within the reaction container and then the reaction container was evacuated by the mechanical booster pump to a vacuum level of $1\times10^{-4}$ torr. At the same time, the power source of the heater for heating the Al drum was turned ON and the Al drum was heated at a setting temperature of 300° C. Then, a microcrystalline blocking layer 6 with a thickness of 1.5 μm was formed, as a first layer, at a reaction pressure level of 0.8 torr and application power of 200 W for 10 minutes, while introducing:

(1) $SiH_4$ gas at a flow rate of 300 SCCM,
(2) $B_2H_6$ gas at a flow ratio of $B_2H_6/SiH_4$ of $5\times10^{-4}$,
(3) $CH_4$ gas at a flow rate of 20% of $SiH_4$ gas and
(4) Argon gas at a flow rate of 200 SCCM.

Then, all the gases were stopped, with the application power at 0 W, and allowed to stand for 15 minutes. Thereafter, an amorphous photoconductive layer 8 with a thickness of 22 μm was formed, as a second layer, at a reaction pressure level of 1.4 torr and application power of 400 W for 1.5 hours, while introducing (1) $SiH_4$ gas at a flow rate of 600 SCCM,
(2) $B_2H_6$ gas at a flow ratio of $B_2H_6/SiH_4$ $1\times10^{-7}$ and
(3) Ar gas at a flow rate of 500 SCCM.

With the application power at 0 W and all the gases stopped, this state was allowed to stand for 15 minutes. Then, a surface layer (a third layer) 10 was formed at a reaction pressure level of 0.6 torr and application power of 200 W for 20 minutes, while introducing the $SiH_4$ gas at a flow rate of 100 SCCM and the $CH_4$ gas at a flow rate of 450 SCCM. Finally, the heater was stopped with the supply of all the gases stopped, and allowed to stand for 20 minutes. Then, nitrogen gas was introduced into the reaction container, and the Al drum with these films formed thereon was cooled. When it was cooled below 100° C., the supply of nitrogen gas was stopped, and the Al drum was taken out of the reaction container. In this way, these films were formed to provide an electrophotographic photosensitive member 2 as shown in FIG. 1. Here, a sample-1 (this embodiment) was analyzed and it was found that the hydrogen content was 3.85%.

Tests were conducted under the same conditions as set out above, except for the condition of the thickness of the respective films or layers, the results of which are tabulated in Table 1. Here, the first layer of the Comparative Example was not made of μc—Si, but made under the same conditions as the surface layer of Example-1.

TABLE 1

| Sample No. | Film thickness: Microcrystalline layer | Amorphous layer | Surface layer |
|---|---|---|---|
| Example 1 | 1.5 | 22 | 2 |
| Example 2 | 1.0 | 22 | 2 |
| Example 3 | 0.5 | 22 | 2 |
| Example 4 | 0.5 | 12 | 2 |
| Example 5 | 0.5 | 32 | 2 |
| Example 6 | 0.5 | 47 | 2 |
| Comparative Example | *(2.0) | 32 | 2 |

Table 2 shows a comparison between the embodiments of this invention and the Comparative Example, with respect to the electrophotographic characteristic of the electrophotographic photosensitive member.

TABLE 2

| Sample No. | Electrophotographic characteristic: Surface potential (V) after charging | Charge retention rate (%) 15 seconds after charging | Half-life exposure amount | Residual potential (V) | Image |
|---|---|---|---|---|---|
| Example 1 | 472 | 72 | 0.6 | 12 | o |
| Example 2 | 460 | 70 | 0.6 | 12 | o |
| Example 3 | 441 | 69 | 0.5 | 11 | o |
| Example 4 | 420 | 63 | 0.8 | 10 | o |

TABLE 2-continued

| Sample No. | Electrophotographic characteristic | | | | |
|---|---|---|---|---|---|
| | Surface potential (V) after charging | Charge retention rate (%) 15 seconds after charging | Half-life exposure amount | Residual potential (V) | Image |
| Example 5 | 535 | 73 | 0.4 | 15 | o |
| Example 6 | 600 | 78 | 0.3 | 52 | o |
| Comparative Example | 400 | 50 | 0.8 | 120 | x |

[*Image: a circle (o): better a cross (x): impracticable]

From Table-2 it is evident that, in comparison with the Comparative Example, the electrophotographic photosensitive member (Embodiments-1 to -6), according to this invention, shows a high charging capability (a surface potential), a high charge retention capability, a low residual potential level, and a smaller half-life exposure amount; that is, it permits the obtainment of a better picture of high sensitivity.

What is claimed is:

1. A photoreceptor for electrophotography, comprising:

a conductive substrate;

a photoconductive layer comprising an amorphous silicon with a hydrogen content of less than ten atomic percent; and a blocking layer comprising a microcrystalline silicon provided between the conductive substrate and the photoconductive layer, the blocking layer having a thickness of between 0.1 and 3 μm and coming in contact with the photoconductive layer so that a depletion layer is formed in an interfacial region between the photoconductive layer and the blocking layer.

2. An photoreceptor according to claim 1, in which the microcrystalline silicon of the blocking layer is of p-type.

3. An photoreceptor according to claim 1, in which the microcrystalline silicon of the blocking layer is of n-type.

4. An photoreceptor according to claim 2, in which the amorphous silicon of the photoconductive layer is of n-type which is similar in properties to an intrinsic semiconductor.

5. An photoreceptor according to claim 3, in which the amorphous silicon of the photoconductive layer is of p-type which is similar in properties to an intrinsic semiconductor.

6. An photoreceptor according to claim 2, in which the microcrystalline silicon of the blocking layer is doped with an element of Group III of the Periodic Table.

7. An photoreceptor according to claim 3, in which the microcrystalline silicon of the blocking layer is doped with an element of Group V of the Periodic Table.

8. An photoreceptor according to claim 1, further including a surface layer which is formed on the photoconductive layer.

9. An photoreceptor according to claim 8, in which the surface layer is formed of a silicon carbide containing hydrogen.

10. An electrophotographic photosensitive member according to claim 1, in which the photoconductive layer has a thickness of 5 to 50 μm.

11. An photoreceptor according to claim 1, in which the surface layer has a thickness of 0.01 to 10 μm.

12. A photoreceptor as in claim 1 wherein said thickness of said blocking layer is greater than 0.2 μm.

* * * * *